US010046246B2

(12) United States Patent
Muldoon et al.

(10) Patent No.: US 10,046,246 B2
(45) Date of Patent: Aug. 14, 2018

(54) RECONFIGURABLE TOY VEHICLE TRACK, ACCESSORY, AND TRACK SET

(71) Applicant: Mattel, Inc., El Segundo, CA (US)

(72) Inventors: Daniel Muldoon, New York, NY (US); Jeffrey Paris, Kew Gardens, NY (US)

(73) Assignee: Mattel, Inc., El Segundo, CA (US)

( * ) Notice: Subject to any disclaimer, the term of this patent is extended or adjusted under 35 U.S.C. 154(b) by 219 days.

(21) Appl. No.: 14/840,381

(22) Filed: Aug. 31, 2015

(65) Prior Publication Data

US 2016/0121230 A1 May 5, 2016

Related U.S. Application Data

(60) Provisional application No. 62/044,451, filed on Sep. 2, 2014.

(51) Int. Cl.

| | |
|---|---|
| ***A63H 19/30*** | (2006.01) |
| ***A63H 19/34*** | (2006.01) |
| ***A63H 19/36*** | (2006.01) |

(52) U.S. Cl.

CPC ..... *A63H 19/30* (2013.01); *A63H 19/34* (2013.01); *A63H 19/36* (2013.01)

(58) Field of Classification Search

CPC ..... A63H 19/30; A63H 19/34; A63H 19/36; A63H 33/062; A63H 18/02; A63H 19/24; A63H 33/42; A63H 19/00

USPC ..... 238/10 R, 10 A, 10 F

See application file for complete search history.

(56) References Cited

U.S. PATENT DOCUMENTS

| | | | | |
|---|---|---|---|---|
| 2,534,458 A * | 12/1950 | Larrabee | A63H 18/02 238/10 C |
| 2,655,116 A | 10/1953 | Gowland | |
| 3,145,501 A * | 8/1964 | Grosser | A63F 7/3622 403/119 |
| 3,680,777 A | 8/1972 | Arai | |
| 4,449,665 A | 5/1984 | Goldfarb et al. | |
| 4,505,686 A * | 3/1985 | Mariol | A63H 33/003 446/434 |
| 4,661,080 A | 4/1987 | Goldstein et al. | |
| 4,767,053 A | 8/1988 | Cook et al. | |

(Continued)

OTHER PUBLICATIONS

Thomas the Train: Take-n-Play Bridge Fold-Out Track, http://www.ebay.com/itm/Thomas-the-Train-Take-n-Play-Bridge-Fold-Out-Track-New-/311381614394?hash=item487fca5f3a, 1 page, accessed on Aug. 31, 2015, product from 2011.

*Primary Examiner* — Mark T Le

(74) *Attorney, Agent, or Firm* — Edell, Shaprio & Finnan, LLC

(57) ABSTRACT

A reconfigurable toy vehicle track, accessory, and track set may each be moved between multiple positions in order to provide multiple configurations. A first toy vehicle track section may include a first portion and a second portion that are pivotally or rotatably coupled together. A second toy vehicle track section may include an accessory that is rotatably coupled thereto and pivotable with respect to the second track portion between at least a first position which may elevate the second track portion and a second position in which the accessory extends above the second track portion. Including the first track section, the second track section, and supports in a track set provides a track set that may be reconfigured between a flat configuration and an elevated configuration without disconnecting any track portions.

10 Claims, 9 Drawing Sheets

(56) References Cited

U.S. PATENT DOCUMENTS

| | | | | |
|---|---|---|---|---|
| 5,456,410 | A | 10/1995 | Chow | |
| 5,709,581 | A | 1/1998 | Rothbarth et al. | |
| 5,785,573 | A | 7/1998 | Rothbarth et al. | |
| 5,890,948 | A | 4/1999 | Nilsson | |
| 5,908,343 | A | 6/1999 | Rothbarth et al. | |
| 5,967,052 | A * | 10/1999 | Prokopf ..... | A63H 18/02 104/126 |
| 6,004,021 | A | 12/1999 | Rothbarth | |
| 6,074,269 | A | 6/2000 | Rothbarth et al. | |
| 6,647,893 | B1 | 11/2003 | Fugitt et al. | |
| 6,883,719 | B2 | 4/2005 | Pyrce | |
| 7,922,101 | B2 | 4/2011 | Norman et al. | |
| 8,297,527 | B2 | 10/2012 | Norman et al. | |
| 8,986,064 | B2 * | 3/2015 | Spielberger ..... | A63H 18/028 446/108 |
| 2013/0045656 | A1 | 2/2013 | Aigner et al. | |
| 2013/0126628 | A1 | 5/2013 | DiBartolo et al. | |

* cited by examiner

RECONFIGURABLE TOY VEHICLE TRACK, ACCESSORY, AND TRACK SET

CROSS REFERENCE TO RELATED APPLICATIONS

This application claims priority to and the benefit of U.S. Provisional Patent Application No. 62/044,451, filed Sep. 2, 2014, entitled "Reconfigurable Toy Vehicle Track, Accessory, and Track Set," the contents of which are hereby incorporated by reference in their entirety.

FIELD OF THE INVENTION

The present invention relates to a toy vehicle track, accessory, and track set, and in particular, to a reconfigurable toy vehicle track set that includes parts, such as track portions and accessories, that may be reconfigured between various positions in order to reconfigure the track set.

BACKGROUND OF THE INVENTION

Toy vehicle track sets have been popular for many years and generally include one or more track sections arranged to form a path around which one or more toy vehicles can travel. Toy vehicles that may be used on such track sets may either be self-propelled or non-powered. In order to move a non-powered toy vehicle around the track, a non-powered vehicle may be propelled by an external source or moved by hand. Regardless, in order to increase the play value of toy vehicle track sets, various track amusement features and accessories have been added to toy vehicle track sets. For example, track features, such as stunt devices or elements, including loops, jumps, collision intersections, etc., and track accessories, such as gates, rails, buildings, stations, bridges, etc. have been included in track sets to increase the play value of the track sets.

Additionally, toy vehicle track sets, such as toy train track sets, are typically built to grow with a child, insofar as a track set may initially be configured as a simple oval track and grow to include many pathways, bridges, tunnels, and various accessories. In order to allow the track to be reconfigured, any track pieces or sections included in a track set may include male and female connections to enable the track pieces or sections to mate, such that the track pieces are interchangeable. Similarly, any toy vehicles, such as toy trains, may also include male and female connections to allow different toy vehicles to be linked together as desired to form different toy vehicle configurations. However, while individual toy vehicle track set accessories and toy vehicles may increase the play value of a toy vehicle track set as it is reconfigured, the accessories themselves are typically not reconfigurable to provide multiple track features or stunt elements. Accordingly, a track set, track portion, or accessory that is reconfigurable to provide multiple toy vehicle track features is desired.

SUMMARY OF THE INVENTION

According to at least one exemplary embodiment of the present invention, a toy vehicle track section includes a track extending from a first end to a second end, the track including at least one first track section disposed between the first end and second end and a second track section disposed proximate the second end. The at least one first track portion is repositionable between a flat position and an angled position. The second track section includes a repositionable accessory that is repositionable between a first position and a second position. Positioning the accessory in the first position causes the first track section to move to the angled position and elevates the second end of the track.

According to another exemplary embodiment of the present invention, a toy vehicle track section includes a track member extending from a first end to a second end, a hinge portion coupled to at least one of the first end or the second end, and a support structure coupled to the track member. The support structure is reconfigurable between a first position and a second position. The support structure extends below at least a portion of the track member and supports the track member a distance above a support surface in the first position and the support structure extends above at least a portion of the track member in the second position. The hinge portion allows the track member to remain coupled to a second track member when the support structure is moved between the first position and the second position.

In still yet another exemplary embodiment of the present invention, a toy vehicle track section includes a first track portion including a first portion of a pivotable joint and a second track portion including a second portion of the pivotable joint. One of the first portion of the pivotable portion and the second portion of the pivotable joint includes a male portion and the other includes a female portion so that the first track portion and the second track portion of the pivotable joint are configured to releasably mate to form the pivotable joint. The pivotable joint is configured to provide a range of angular orientations.

BRIEF DESCRIPTION OF THE DRAWINGS

Like reference numerals have been used to identify like elements throughout this disclosure.

DETAILED DESCRIPTION OF THE INVENTION

Generally referring to the figures, a reconfigurable toy vehicle track set is shown. As can be seen, the toy vehicle track set includes multiple track portions, including at least one reconfigurable or repositionable track portion, and accessories that may also be reconfigurable to provide new and interesting play features. More specifically, in one embodiment, the track set includes pivotable joints or hinge track portions which allow the track set to provide configurations with different elevations, hills, or inclines, and reconfigurable accessories which allow the track set to include either a bridge or a tunnel-type structure, as desired.

Still referring generally to the figures included herein, each of the toy track sets 100 may be configured for use with any desirable toy vehicle. In the particular embodiments shown herein, a motorized toy vehicle 400 which resembles a train is used with the various embodiments of track set 100. The train shown herein is also configured to be coupled to additional toy trains or train cars (e.g., via male and female mating portions to form a single toy vehicle). However, in other embodiments, vehicle 400 may be any desirable toy vehicle, include any desirable number of toy vehicles, of any type (e.g., powered or unpowered/free-wheeling), joined together or used individually.

Figure 1:
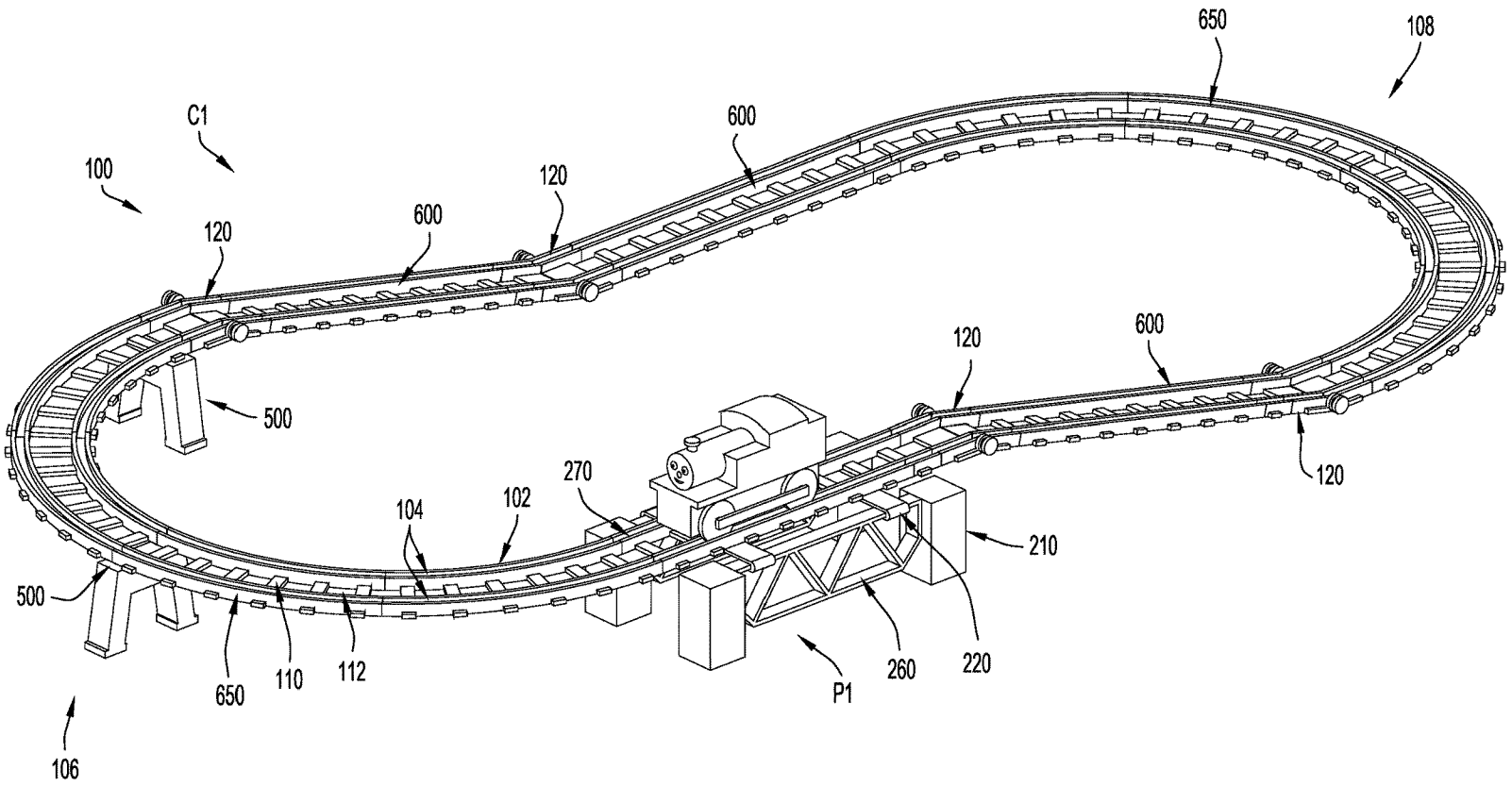
FIG. 1 shows a top perspective view of an exemplary embodiment of a toy vehicle track set according to the present invention with the track set in a first configuration.

Now turning to FIG. 1, one exemplary track set 100 according to the present invention is shown. The track set 100 includes at least one first reconfigurable track portion 120, which may also be referred to herein as a pivotable joint 120, a hinge portion 120, or a hinge track portion 120, and a second reconfigurable track portion 210. The track set 100 also includes straight track portions 600 and curved track portions 650 that may allow a user to build a closed loop track or connect the reconfigurable track portions as desired. For example, in FIG. 1, track portions 600 and 650, provide a closed loop oval extending from a first end 106 to a second end 108. However, it is to be understood that in other embodiments, any desirable track portions, sections, pieces, etc. may be incorporated into track set 100, as desired.

As can be seen, each track portion 120, 210, 600, 650 used to form the track set 100 includes at least one pathway or channel 104 formed by opposite side walls along/within which a toy vehicle can travel. In this particular embodiment, the track set 100 is configured for use with at least toy trains, such as toy vehicle 400, and, thus, includes two parallel channels 104 formed within each track portion 120, 210, 600, 650 that form the track set 100. In order to resemble a train track, each track portion 120, 210, 600, 650 may also include central portions 110 resembling railroad ties extending between the pathways 104. Openings 112 (seen best in FIG. 12) may space the central portions 110 apart from each other.

Moreover, each track portion 120, 210, 600, 650 may include connectors or mating portions configured to couple each track section to other sections of track, thereby rendering the track set 100 reconfigurable to various configurations. Preferably a first end of each track portion 120, 210, 600, 650 includes an arrangement of at least one male connector 114 and at least one female connector 116 and a second, opposite end of the same track portion includes an arrangement of male and female connectors 114, 116 which mirrors the arrangement included on the first end (as seen, for example, in FIGS. 2-3). In some embodiments, the track set 100 may also include various connectors and stands to stabilize and/or support track set 100, if desired. In the embodiments shown herein, the track set 100 includes a second track section 210 with supports 260, 270 (discussed in detail below) and two supports 500 which may each be used to selectively support portions of the track. However, in other embodiments the track set may include two or more supports 500, as desired.

Figure 2:
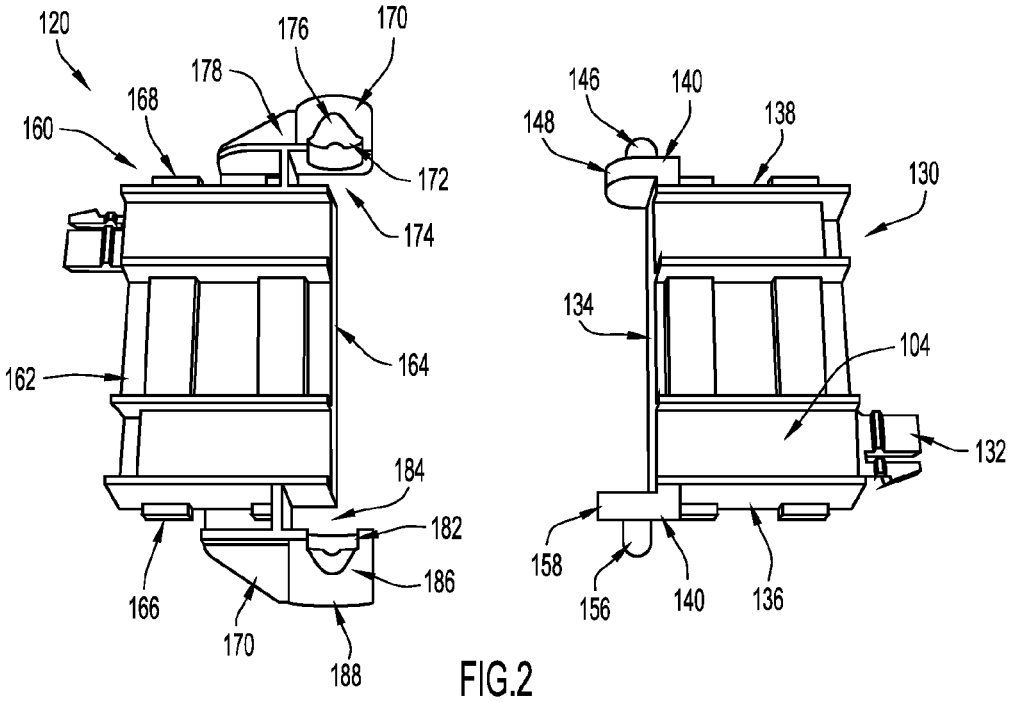
FIGS. 2-3 show top perspective views of a reconfigurable track portion of the track set of FIG. 1. This reconfigurable track portion is also referred to as a hinge track or hinge track portion and is shown assembled in FIG. 3 and unassembled in FIG. 2.
Figure 3:
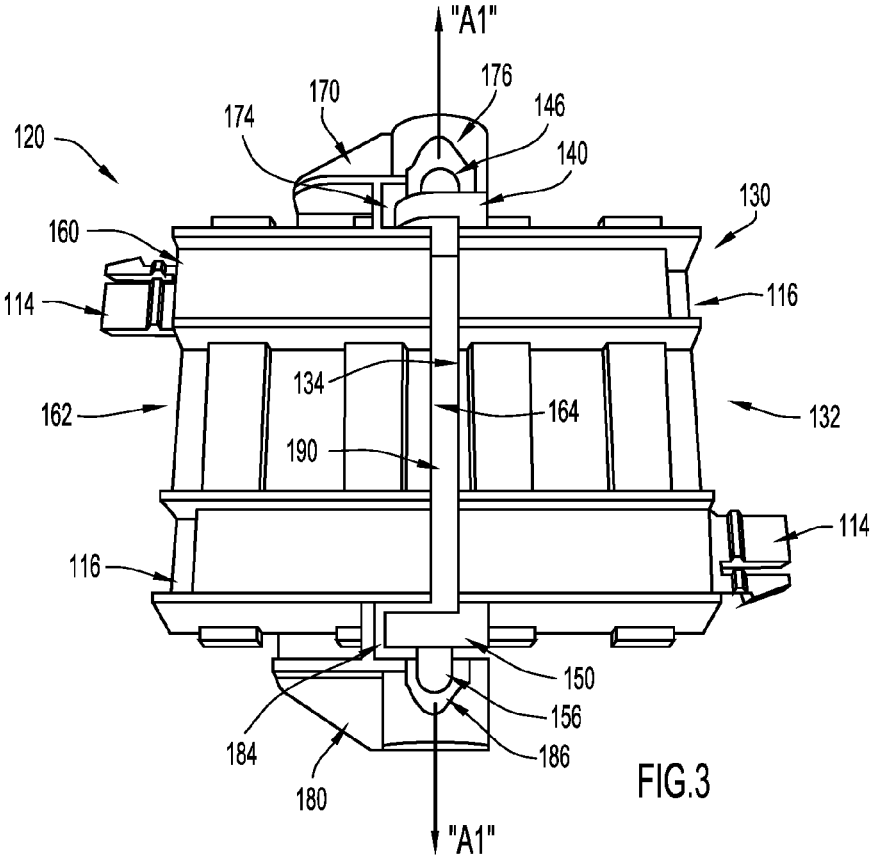

Now turning to FIGS. 2-3, the hinge track portion 120 is shown detached from the track set 100. As can be seen, the hinge track portion 120 includes a first portion 130 and a second portion 160 configured to be rotatably coupled together. Each portion is substantially similar insofar as the first and second portions 130, 160 each include a first end 132, 162 that includes male and female connectors 114, 116 and a second, opposite end 134, 164 that is substantially flat and devoid of connectors 114, 116, respectively. The first side 136, 166 and a second, opposite side 138, 168 of each portion 130, 160 each include at least a portion of a hinge portion 140, 170. Specifically, the first portion 130 includes a male hinge portion 140 and the second portion 160 includes a female hinge portion 170 that allow the first and second portions 130, 160 to be rotatably coupled together.

As seen best in FIG. 2, the male hinge portion 140 includes a first extension member 158 which is laterally offset from, but nearly adjacent to, the first side 136 of the first portion 130 and a second extension member 148 which is laterally offset from, but nearly adjacent to, the second side 138 of the first portion 130. Each extension member 158, 148 also extends away from the second end 134 of the second portion. Thus, each extension member is substantially L-shaped when viewed from a top perspective, as seen in FIG. 2. However, in other embodiments, the extension members 158, 148 may be any desirable shape.

Regardless of the shape of the extension members 158, 148, the first extension member 158 includes a first protrusion 156 with a first diameter or width and the second extension member 148 includes a second protrusion 146 with a second diameter or width. Each of the protrusions 156, 146 extends substantially from the portion of the extension member 158 parallel to the sides 136, 138 of the first portion 130 such that the protrusions 156, 146 extend away from the sides of the 136, 138 of the first portion. In this embodiment, the second protrusion 146 has a larger diameter than the first protrusion 156 in order to ensure the first portion 130 is coupled to the second portion 160 in a specific orientation.

Referring to FIG. 3, the female hinge portion 170 includes a third extension member 188 and a fourth extension member 178 that, similar to the first and second extension members 158, 148, extend away from the second end 164 in a direction parallel to the first and second sides 166, 168. However, in contrast with the first and second extension members 158, 148, the third and fourth extension members 188, 178 do not extend adjacent the first and second sides 166, 168. Instead, a first recess 184 is formed between the third extension member 188 and the first side 166 and a second recess 174 is formed between the fourth extension member 178 and the second side 168. As is discussed in detail below, the recesses 184, 174 are preferably sized to receive the first and second extension members 158, 148, however, in other embodiments, the recesses 184, 174 may be sized as desired.

In addition to including recesses 184, 174, the female hinge portions 170 also differ from the male hinge portion 140 because the female hinge portions 170 do not include any protrusions. Instead, the extension members 188, 178 each include a central cavity 182, 172, respectively, sized to rotatably receive the protrusions 156, 146 of the male hinge portions 140. However, the central cavities 182, 172 do not extend through the extension members and, instead, are only accessible from their respective recess 174, 184. Moreover, since preferred embodiments of second portion 160 include recesses 184, 174 sized to receive only a single extension member 158, 148, the third and fourth extension members 188, 178 also include keyed openings 186, 176, respectively, to allow the protrusions 156, 146 to be inserted into the central cavities 182, 172. In this embodiment, the keyed openings 186, 176 are aligned with the top surface or edge of the third and fourth extension members 188, 178 and, thus, the male hinge portion 140 of the first portion 130 can only be inserted into the female portion 170 of the second portion 160 after aligning the male hinge portion 140 above the female hinge portion 170.

Now referring to FIG. 3, with continued reference to FIG. 2, once the male hinge portion 140 of the first portion 130 of the hinge track portion 120 is disposed above the female hinge portion 170 of the second portion 160 of the hinge track portion, the first portion 130 may simply be pushed downwards in order to mate the two hinge portions 140, 170 and rotatably couple the first portion 130 to the second portion 160. When sufficient force is applied to couple the first portion 130 to the second portion 160, the first protrusion 156 is rotatably disposed within the first central cavity 182 and the second protrusion 146 is rotatably disposed within the second central cavity 172. Notably, in this embodiment, the second keyed opening 176 is larger than the first keyed opening 186, such that only the second keyed opening 176 can receive the larger second protrusion 146. This alignment feature ensures that the channels 104 of each portion face in the same direction (e.g., upwards) when 130 and 160 are connected. Moreover, this alignment ensures that the connectors 114, 116 included on the first and second portion 130, 160 have a mirrored arrangement, thereby allowing the hinge portion 120 to be removably coupled to other track portions, such as the straight track portions 600 and curved track portions 650 shown in FIG. 1, at either end.

Figure 4:
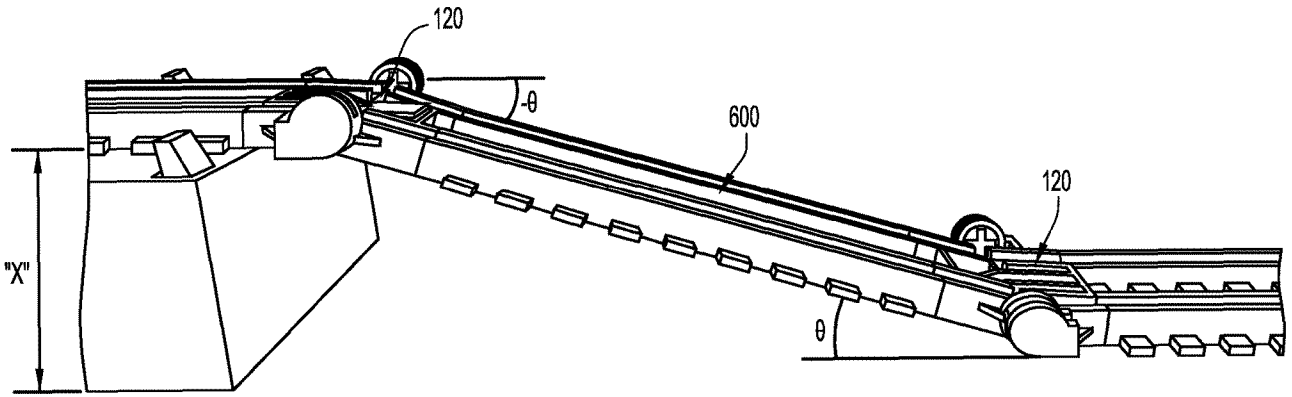
FIGS. 4-5 show side perspective views of the hinge track portion of FIGS. 2-3 coupled to additional track portions, the hinge track portion providing an angled track configuration in FIG. 4 and a flat track configuration in FIG. 5.
Figure 5:
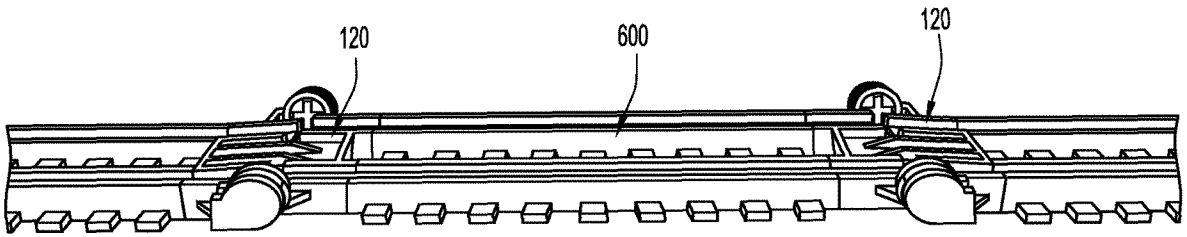

Still referring to FIGS. 2-3, but now with reference to FIGS. 4-5 as well, the male and female hinge portions 140, 170 allow the hinge track portion 120 to provide an angled connection or coupling in a track set 100. For example, when, as seen in FIGS. 4-5, straight track portions 600 are coupled to either end of a hinge portion 120, the hinge portion 120 may provide an angled connection therebetween, such that at least one of the straight track portions 600 provides an uphill, downhill, or otherwise angled track portion. As seen best in FIG. 3, the hinge portions 130, 160 are preferably coupled together with a gap 190 between their second ends 134, 164 in order to allow the first and second portions 130 and 160 to rotate through a certain range with respect to each other without abutting. However, regardless of the inclusion or size of gap 190, the portions 130, 160 may be configured to rotate about an axis "A1" (see FIG. 3) that is aligned with the protrusions 146, 156.

In this particular embodiment, the gap 190 between the second ends 134, 164 is sized to allow the first and second portions 130, 160 to either lie flat on a support surface (as shown in FIG. 5) or to rotate with respect to each other, such that the first and second portions 130 and 160 are angled with respect to each other. In this embodiment, the angle between the first portion 130 and the second portion 160 ranges from approximately −40° to approximately 40°, where a negative angle implies that one of the portions 130, 160 is angled downwards with respect to the other portion 130, 160. However, in preferred embodiments, the angle between the first portion 130 and the second portion 160 may range from approximately −25° to approximately 25°, which may increase the chance of a toy vehicle traveling on inclined track without falling off. In yet other embodiments, the angle between the first portion 130 and the second portion 160 may be manipulated to any desired angle.

An example of how a pivotable joint 120 may provide angled track portions is shown in FIG. 4. In FIG. 4, a first hinge portion 120 provides an angle θ and a second hinge portion 120 provides an angle of −θ. Accordingly, a track portion 600 extending between the hinge portions 120 provides a ramp which allows a toy vehicle to either travel upwards to an elevation of "X" or travel down to a support surface from an elevation of "X." In some embodiments, "X" is about 1-4 inches, but may vary in different embodiments since "X" depends on the length of the track portion 600 extending between the hinge portions 120 and the angle θ provided by the hinge portion (as determined with basic trigonometry).

Figure 6:
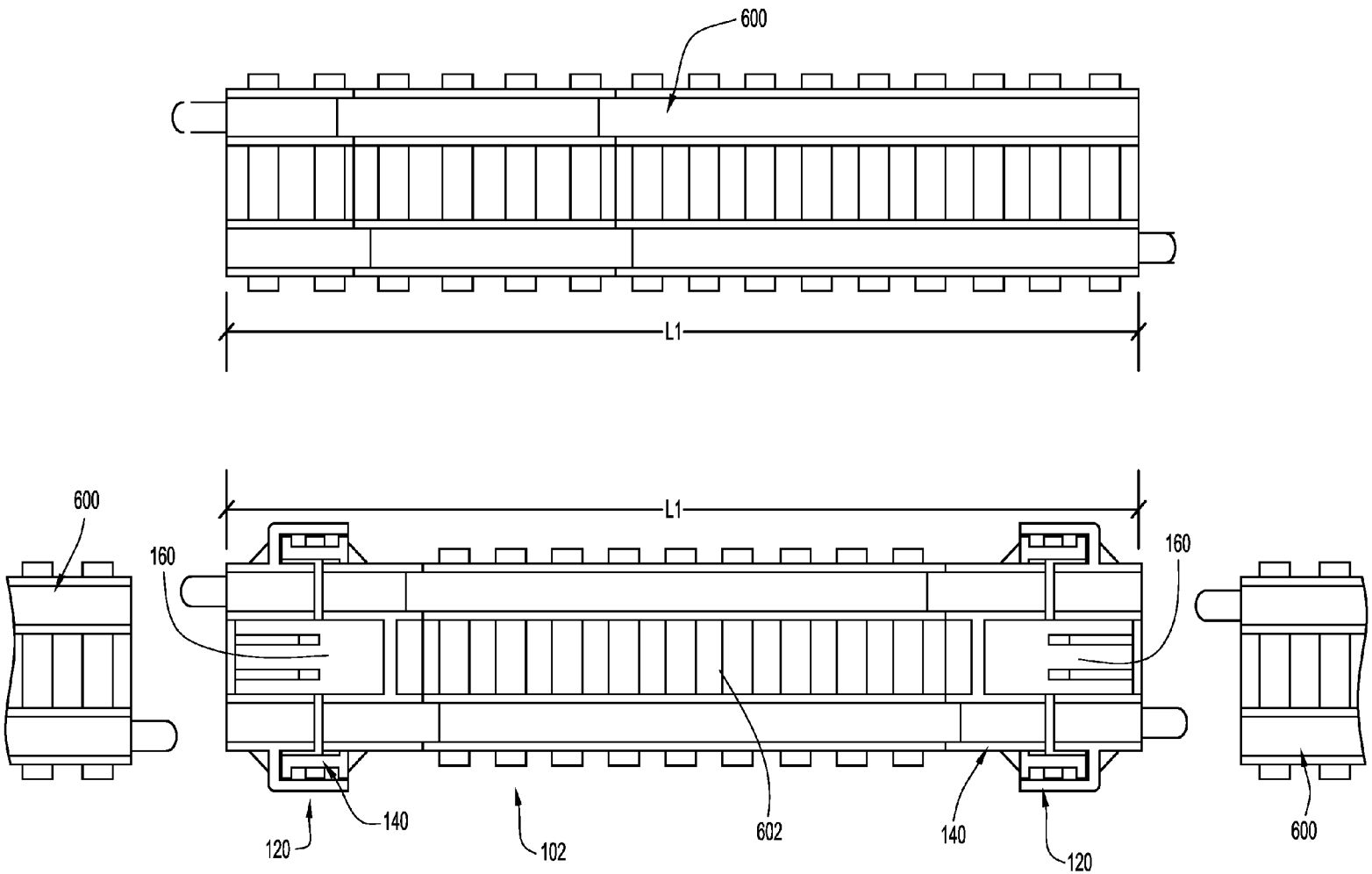
FIG. 6 shows a top perspective view of another embodiment of a hinge track portion according to the present invention.

Now turning to FIG. 6, a modified track portion 602 with built in hinge portions 120 is shown. In this embodiment, the track portion 602 includes a straight track portion 600 with first portions 140 of two hinge portions 120 included or built into its ends. The second portions 160 are rotatably coupled to the first portions 140 in order to form hinge portions 120 on each end of the modified track portion 602 that are substantially similar in both function and structure (e.g., size and configuration) to the hinge portions 120 shown in FIGS. 2-3. Thus, the modified track portion 602 may essentially provides a ramp or incline in and of itself.

Notably, in FIG. 6, the modified track portion 602 (including the hinge portions 120) has a length "L1" that is substantially the same as the length of an exemplary straight track portion 600. Although straight track portions 600 may have any desirable length in various embodiments, straight track portions 600 may be typically produced with a certain length, such as L1. In such embodiments, it may be desirable to simply replace a straight track portion 600 with a modified track portion 602, such that the track set 100 can be modified to include ramps or inclines with minimal additional pieces (e.g., modified track portion 602). Accordingly, in some embodiments, it may be desirable to produce a modified track portion 602 that is substantially the same size as a typical straight track portion 600, as is shown in FIG. 6.

However, it is also to be understood that the overall size provided by the embodiment shown in FIG. 6, could also be achieved with hinge portions 120 and straight track portions 600 that are each formed separately. Accordingly, the advantages of the size of modified track portion 602 described above may also apply to the hinge portions 120 shown in FIG. 2-3 when these hinge portions 120 are removably coupled to either side of a straight track portion 600. As an example, certain track sets may include two straight track portions 600 of a first length and may also include two straight track portions 600 of a second, shorter length. When the shorter straight track sections 600 are combined with two hinge portions 120, the combined length of the shorter straight track section 600 and the two hinge sections 120 may equal the length of the first, longer track portions 600. This sizing system may be especially preferable for track sets 100 designed to provide a closed loop track, since track portion length may determine whether a loop can be closed.

Figure 7:
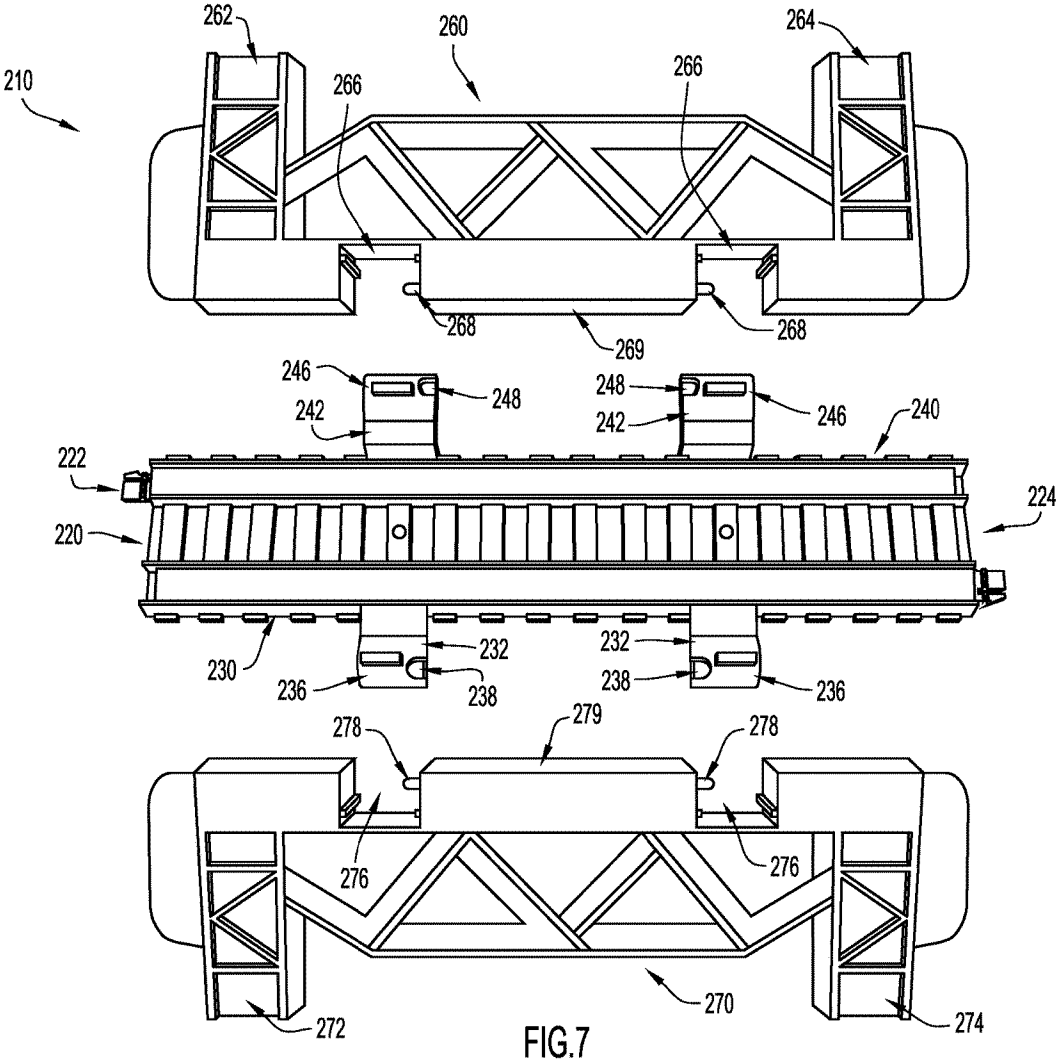
FIG. 7 shows a top perspective view of a second track portion of the track set of FIG. 1, the second track portion being disassembled.
Figure 8:
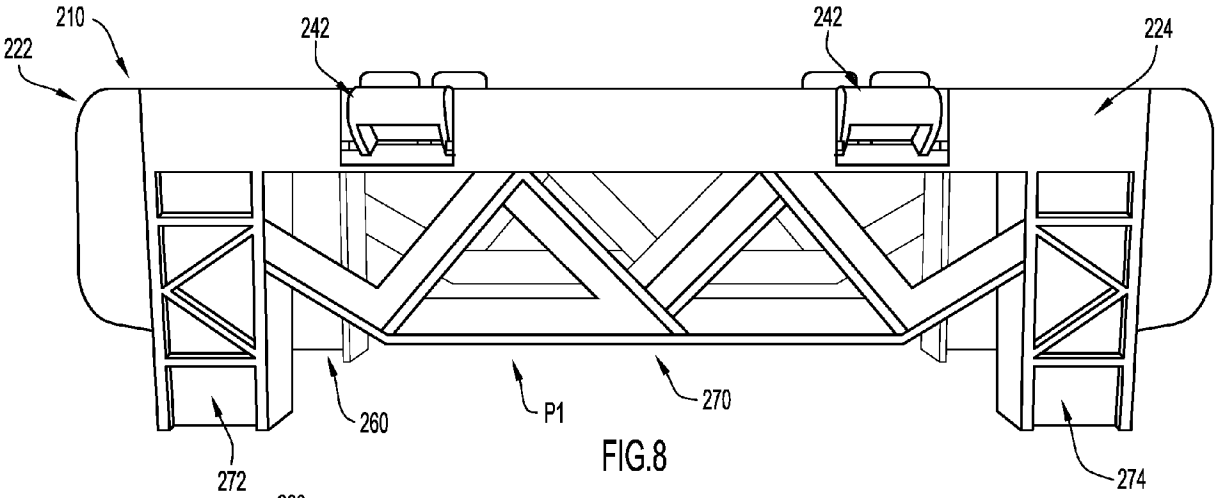
FIGS. 8-9 show side and top perspective views, respectively, of the second track portion of FIG. 7 while assembled.
Figure 9:
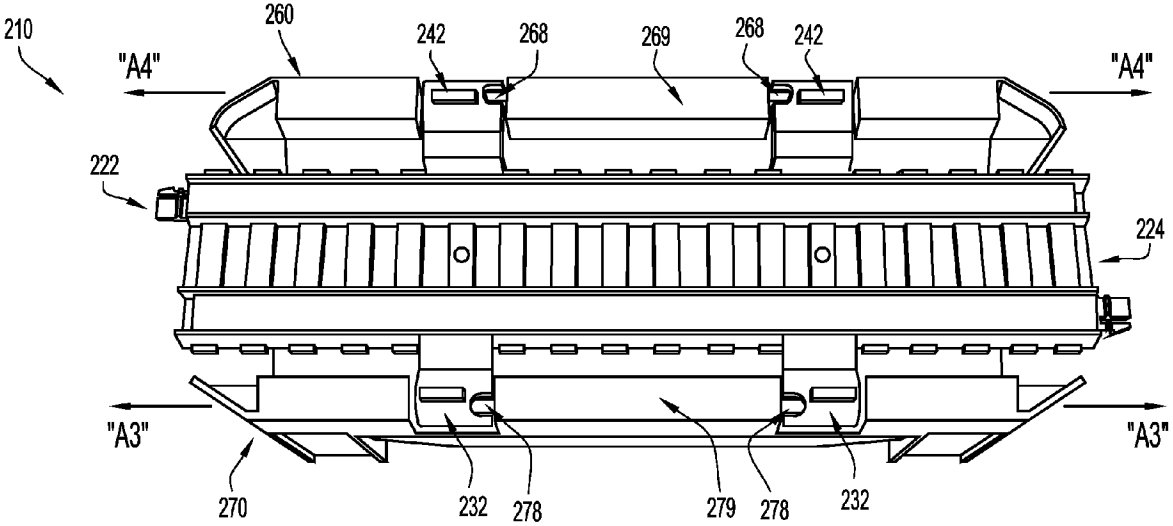

Now turning to FIGS. 7-9, a second track section 210 is shown. As can be seen, the second track section 210 includes a track portion 220 and a reconfigurable accessory. The reconfigurable accessory, which may be referred to alternatively as support structure, includes a first portion 260 and a second portion 270 that are each independently, removably rotatably coupleable to the track portion 220, such that the first and second portions 260, 270 may each rotate between a first position P1 (see FIG. 1) and a second position P2 (see FIG. 10) when coupled to the track portion. In some embodiments, the first position P1 provides a support or bridge configuration and the second position P2 provides a sidewall or tunnel configuration. In other words, the second track section 210 may alternately provide a bridge or tunnel depending on the position of the portions 260, 270 of the accessory.

Now referring to FIG. 7 specifically, the track portion 220 extends from a first end 222 to a second end 224 and includes channels 104 extending therebetween. The track portion 220 also includes a first side 230 with mounts 232 and a second side 240 with mounts 242 and each of the mounts 232, 242 is configured to rotatably receive a portion 260, 270 of the accessory. Specifically, mounts 232 are configured to receive the first portion 270 of the accessory and mounts 242 are configured to receive the second portion 260 of the accessory. In order to engage the mounts 232, the second portion 270 includes a mating edge 279. Similarly, the first portion 260 includes a mating edge 269 configured to engage mounts 242. Each portion 270, 260 also includes two posts 272, 274, 262, 264 extending away from their respective mating edge 279, 269.

To connect the mating edges 279, 269 of the respective portions 270, 260 with the mounts 232, 242, the mating edges 279, 269 each include male hinge portions similar to the male hinge portions included on the hinge track portion 120. Specifically, mating edge 279 includes recesses 276 and protrusions 278 that project laterally into these recesses. In this embodiment, the protrusions 278 each extend outwardly from a central portion of the second portion 270 (as opposed to extending in the same direction). Similarly, the first portion 260 includes recesses 266 along its mating edge 269 and protrusions 268 that extend laterally in the same manner that protrusions 278 extend within recesses 276. Meanwhile, each of the mounts 232 and 242 includes a receiver 236, 246 configured to rotatably receive the protrusions 278, 268 therein. However, similar to the hinge portion 120, the protrusions 278, 268 can only be inserted into their respective receivers 236, 246 via keyed apertures 238, 248.

In the embodiment shown in FIGS. 7-9, the track portion 220 includes two mounts 232, two mounts 242 and the first and second portions 260, 270 each include two corresponding protrusions 278, 268. However, in other embodiments, any amount of mounts and protrusions may be included. Additionally, in this embodiment, the keyed apertures 238, 248 are disposed atop of the receivers 236, 246, but in other embodiments, the apertures 238, 248 may disposed in any desirable location. Regardless of the number and location of these features, the first and second portions 260, 270 may be able to rotate with respect to the track portion 220. Specifically, as shown in FIG. 9, the second portion 270 may rotate with respect to the track portion about Axis "A3" while the first portion 260 may rotate with respect to the track portion 220 about axis "A4." Accordingly, the first and second portions 260, 270 of the accessory may rotate between a first position P1 (see FIG. 1) which may provide a bridge-type structure and a second position P2 (see FIG. 10) which may provide sidewalls of a tunnel-type structure.

Figure 10:
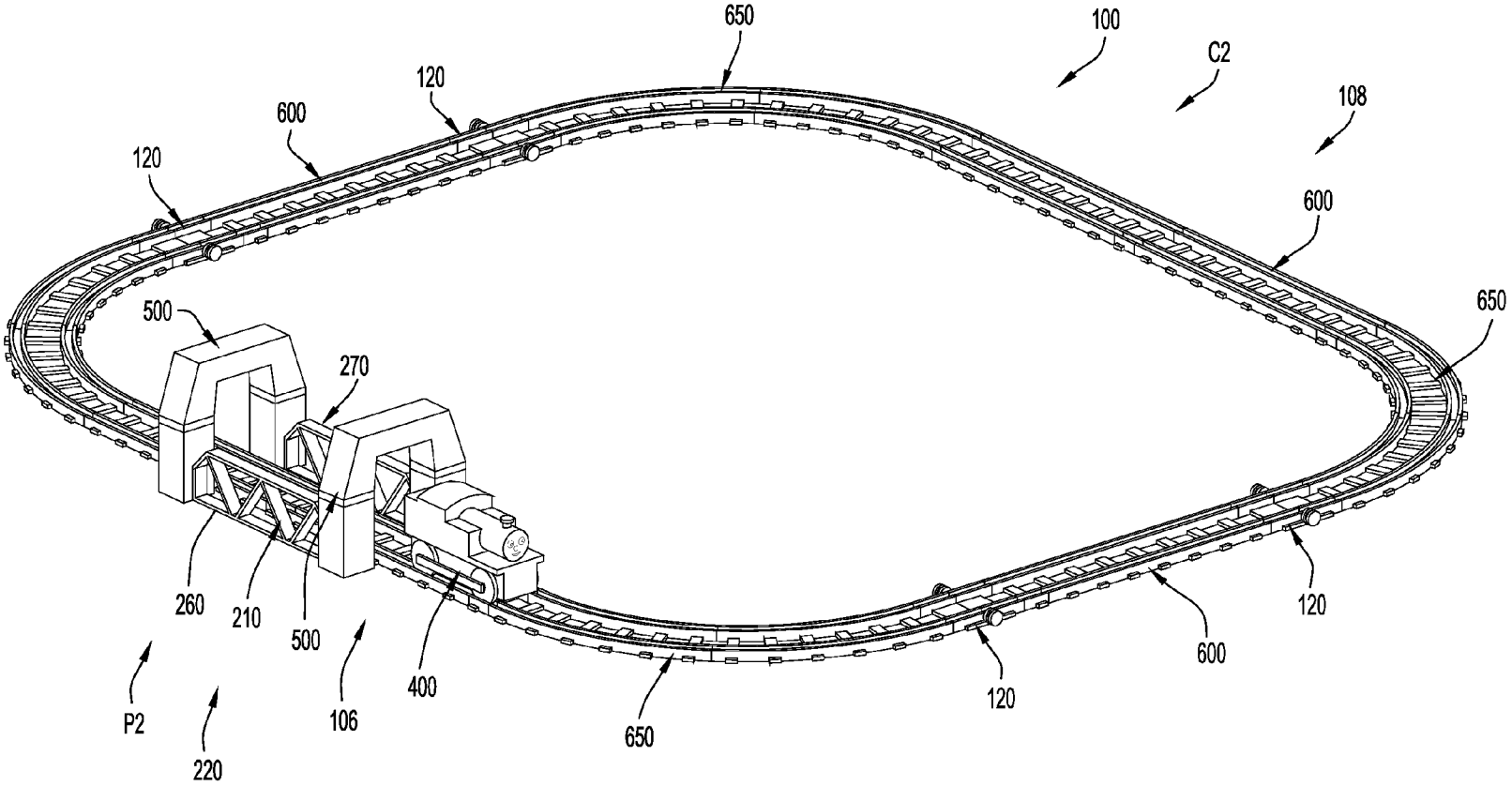
FIG. 10 shows a top perspective view of the track set of FIG. 1 with the track set in a second configuration.

Now turning to FIG. 10, with reference to FIG. 1 as well, in FIG. 10, the track set 100 is shown in a first configuration C1 (FIG. 1) and a second configuration C2 (FIG. 10). As can be seen in FIG. 1, when the track set 100 is in the first configuration C1, the track set provides an elevated section at its first end 106 and a non-elevated section at its second end 108. In order to provide this elevated section, hinge track portions are disposed on either side of the track (between the first and second ends 106, 108) and provide inclined sections between the first and second ends 106, 108. Then, the accessory is moved into its first position P1 to support a portion of the elevated track and supports 500 are staggered beneath the remaining elevated track. Notably, when the accessory is in its first position P1, the posts 272, 274, 262, 264 engage the ground in order to stably support the second track section 210 in an elevated position above the support surface. Meanwhile, the supports 500 engage openings 112 included in the curved track sections 650 in order to secure the curved track section 650 a distance above the support surface, as is described below.

By comparison, in FIG. 10, the track set 100 is in its second configuration C2. In this configuration, the elevated portion of the track set 100 is removed and, instead, a tunnel-type structure is provided on the track set. In order to provide the tunnel, the accessory portions 260, 270 are rotated to their second positions P2 and each support 500 is used to couple a first post 272, 274 to a second post 262, 264, as is described below. When the track set 100 is in its second configuration C2, the hinge portions 120 are still included in the track set 100, but simply lie flat.

Still referring to FIGS. 1 and 10, in the second configuration C2 shown in FIG. 10, the track set 100 is arranged in a rectangular loop, as opposed to an ovular loop (as seen in FIG. 1). However, it is to be understood that the track set 100 may be considered to be in its second configuration C2 when the track is substantially flat and the accessory provides a tunnel-type structure, regardless of the shape (e.g., the track shape shown in FIG. 1 could be reconfigured without disconnecting any track portions in order to provide the second configuration C2). Similarly, it is to be understood that the track set 100 may be considered to be in its first configuration C1 when the track set and the accessory provide an elevated portion (e.g., the track shape shown in FIG. 10 could be reconfigured without disconnecting any track portions in order to provide the first configuration C1). The hinge portions 120, the second track section 200, and supports 500 allow the track set to be easily reconfigured between these two configurations.

Figure 11:
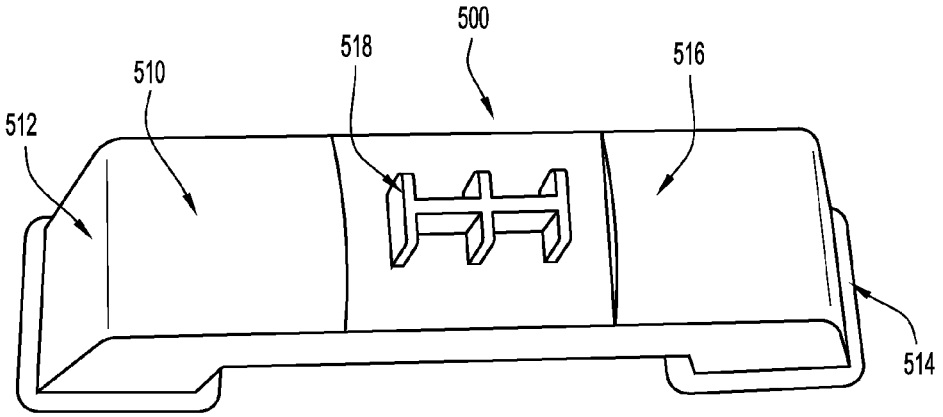
FIGS. 11-12 show top perspective views of the supports of the track set of FIG. 1.
Figure 12:
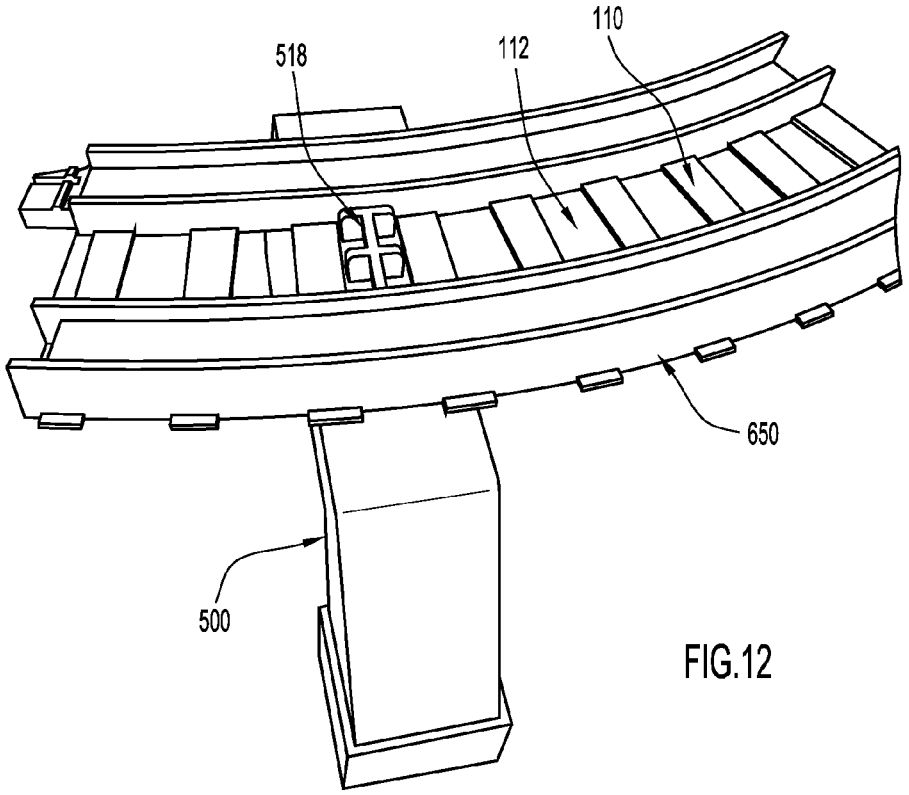
Figure 13:
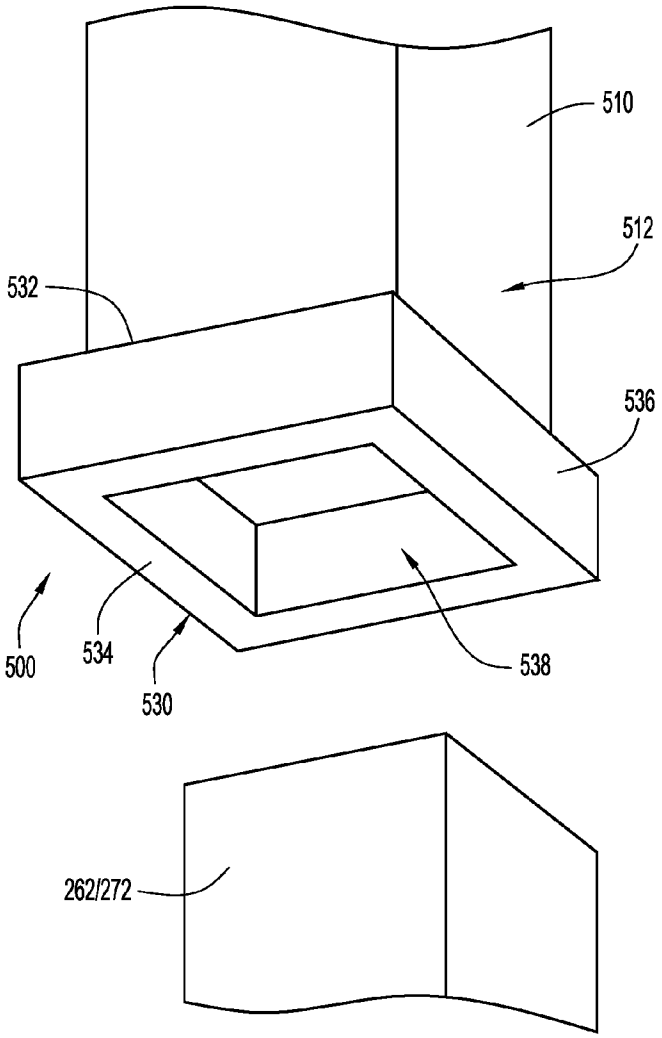
FIG. 13 shows a bottom perspective view of the supports of FIG. 1 being mounted onto the second track portion of FIG. 1 in the position shown in FIG. 10.

FIGS. 11-13 show supports 500, or portions thereof, in order to demonstrate how the supports may be moved between the positions shown in FIGS. 1 and 10. First, in FIGS. 11-12, a support 500 is shown from a top view and from a side view, respectively, supporting an arcuate track portion 650. As can be seen in these figures, each support 500 includes an elongate member 510 that includes a first leg 512, a second leg 514, and a top section 516 extending between the first and second legs 512, 514. Additionally, a post 518 configured to engage an opening 112 included in any desirable track portion, such as curved track portion 650, extends upwards from the top section 516. For example, in the illustrated embodiment, the post 518 is configured to frictionally engage the openings 112 included in the curved sections 650 and the hinge portions 120, but is not configured to engage the openings included in the second section 210 and straight track portions 600, thereby limiting the support positions that the supports 500 may be placed in. Limiting the support positions in this manner may encourage a user to place the supports adjacent or close to any height transition points and elevated curves, which may be the locations most susceptible to allowing a vehicle to derail if left unsupported.

In addition to the post 518, the supports 500 also include bases at the bottom of each leg 512, 514 in order to allow the supports to stabile engage a support surface and/or be mounted atop of the posts 262, 264, 272, 274 included in the portions 260, 270 of the accessory. FIG. 13 depicts one such base 530 with the understanding that the bases included on both legs 512, 514 are substantially identical. As such, the description of base 530 applies to the bases included on both leg 512 and leg 514.

Turning to FIG. 13, it can be seen that base 530 includes top surface 532, a bottom surface 534 and a peripheral wall 536 extending therebetween. Additionally, the base includes cavity 538 that extends upwards from the bottom surface 534 within the peripheral wall 536. Generally, the base 530 is wider than the leg 512, 514 it is mounted or included on in order to provide a stable stand for the support 500, however, in various embodiments, the base 530 and its features may be sized as desired. Additionally, the cavity 538 may be sized as desired, however, preferably, the cavity 538 is sized to receive and frictionally engage a portion of either post 272, 274 or 262, 264. Consequently, the support 500 may be mounted onto one post 262 and one post 272 in order to secure the accessory portions 260, 270 in the upright second position P2 while extending over the track portion 220 of the second track portion 210 (as shown in FIG. 10).

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the track portions, track accessories, and track set of the present invention, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Finally, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

What is claimed is:

1. A toy vehicle track set comprising:

a track including:

at least one first track section being repositionable between a flat position and an angled position;

a second track section disposed proximate the first track section, the second track section including a repositionable accessory, the accessory being repositionable between a first position and a second position, wherein positioning the accessory in the first position causes the first track section to move to the angled position and elevates the second track section, the second track section is configured as a bridge when the accessory is in the first position, the accessory in the first position serves as a riser for the second track section, and the second track section is configured as a tunnel when the accessory is in the second position.

2. The toy vehicle track set of claim 1, wherein the first track section further comprises:

a track member extending from a first track end to a second track end;

a first hinge track portion adjacent the first track end; and a second hinge track portion adjacent the second track end, wherein the first hinge track portion and the second hinge track portion allow the track member to move between the flat position and the angled position.

3. The track set of claim 1, further comprising:

at least two supports; the supports being positionable beneath the track to support a portion of the track in an elevated position and being repositionable above the accessory when the accessory is in the second position.

4. The track set of claim 1, wherein the second track section includes a first side and a second side and the accessory comprises:

a first portion rotatably coupled to the first side; and a second portion rotatably coupled to the second side, the first portion and the second portion being individually rotatable to reposition the accessory between the first position and the second position.

5. The track set of claim 4, wherein the first portion and the second portion extend approximately perpendicularly with respect to and beneath the second track section in the first position and extend approximately perpendicularly with respect to and above the second track section in the second position.

6. A toy vehicle track section comprising:

a track member extending from a first end to a second end, the track member having a first side and a second side opposite to the first side;

a hinge portion coupled to at least one of the first end or the second end; and a support structure, the support structure being coupled to the track member and reconfigurable between a first position and a second position, the support structure including a first support and a second support, the first support is rotatably coupled to a first side of the track member and includes a first set of posts, and the second support is rotatably coupled to a second side of the track member and includes a second set of posts, and each of the first set and the second set of posts is configured to engage the support surface when the support structure is in the first position, wherein the support structure extends below at least a portion of the track member and supports the track member a distance above a support surface in the first position and the support structure extends above at least a portion of the track member in the second position, and wherein the hinge portion allows the track member to remain coupled to a second track member when the support structure is reconfigured between the first position and the second position.

7. The toy vehicle track section claim 6, wherein the track section is a bridge when the support structure is in the first position.

8. The toy vehicle track section of claim 6, wherein the track section is a tunnel when the support structure is in the second position.

9. The toy vehicle track section of claim 6, wherein each of the first set of posts includes a first receiver, each of the second set of posts includes a second receiver, and the first receivers and the second receivers are configured to be coupled together by a support that extends over the track member.

10. The toy vehicle track section of claim 6, wherein the first support and second support are individually rotatable with respect to the track member.

* * * * *